US010703390B2

(12) United States Patent
Roll et al.

(10) Patent No.: US 10,703,390 B2
(45) Date of Patent: Jul. 7, 2020

(54) RAILWAY VEHICLE BODY STRUCTURE AND MANUFACTURING PROCESS THEREOF

(71) Applicant: ALSTOM Transport Technologies, Saintouen (FR)

(72) Inventors: Stephane Roll, Brumath (FR); Bruno Delphigue, Evreux (FR)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 352 days.

(21) Appl. No.: 15/794,079

(22) Filed: Oct. 26, 2017

(65) Prior Publication Data

US 2018/0118230 A1 May 3, 2018

(30) Foreign Application Priority Data

Oct. 27, 2016 (FR) ..... 16 60451

(51) Int. Cl.
*B61D 17/04* (2006.01)
*B61D 17/10* (2006.01)

(52) U.S. Cl.
CPC ..... *B61D 17/043* (2013.01); *B61D 17/041* (2013.01); *B61D 17/10* (2013.01)

(58) Field of Classification Search
CPC .... B61D 17/041; B61D 17/043; B61D 17/10; B61D 17/04; B61D 17/00; B23K 20/122; B62D 25/2054; B61F 1/00
See application file for complete search history.

(56) References Cited

U.S. PATENT DOCUMENTS

| | | | | |
|---|---|---|---|---|
| 2005/0120535 | A1 | 6/2005 | Gendou et al. | |
| 2006/0014009 | A1* | 1/2006 | Weidner | B32B 5/18 428/304.4 |
| 2006/0237992 | A1* | 10/2006 | Lemmons | B62D 33/023 296/186.1 |
| 2007/0137517 | A1* | 6/2007 | Creighton | B61D 17/043 105/238.1 |

FOREIGN PATENT DOCUMENTS

| | | | |
|---|---|---|---|
| DE | 33 09 736 | A1 | 9/1984 |
| EP | 0 392 828 | A2 | 10/1990 |
| EP | 2 844 415 | B1 | 3/2015 |
| FR | 2 630 698 | A1 | 11/1989 |
| JP | 2003 275876 | A | 9/2003 |
| WO | 2013/164294 | A1 | 11/2013 |

OTHER PUBLICATIONS

FR Search Report, dated Jul. 17, 2017, from corresponding to FR1660451 application.

* cited by examiner

*Primary Examiner* — Mark T Le
(74) *Attorney, Agent, or Firm* — Young & Thompson

(57) ABSTRACT

A body structure for a rail vehicle that includes a frame with at least one support element made at least predominantly of steel alloy, at least one equipment element made predominantly of aluminum alloy, at least one first plate having at least one longitudinal edge and a first surface delimited by the longitudinal edge, and at least one longitudinal batten of steel alloy, which is integral with the support element, wherein the longitudinal batten is fixed flat to the first face by way of friction melt bonding.

8 Claims, 3 Drawing Sheets

RAILWAY VEHICLE BODY STRUCTURE AND MANUFACTURING PROCESS THEREOF

BACKGROUND OF THE INVENTION

Field of the Invention

The present invention relates to a body structure for a railway vehicle and a method for manufacturing such a body structure.

Description of the Related Art

To make a body structure of a railway vehicle, such as a carriage or a wagon, it is known to assemble elements made of different metallic materials in order to optimize the weight of the body. In particular, the floors of the structure may be made of aluminum, while other parts, such as the support trusses of the floors, are made of steel. In order to ensure the solidity and the longevity of the structure, it is preferable to join together the various elements that compose it by welding. However, welding steel elements to aluminum elements requires special precautions, insofar as these materials are difficult to weld together and tend to generate galvanic corrosion when they are brought into contact with each other.

FR-A1-2 630 698 discloses a vehicle, provided with a body, the structure of which comprises two floor levels formed by plates of extruded aluminum, and faces consisting of vertical uprights and steel stringers designed to support these two floor levels. Composite elements are provided to enable the fixing of the floors to the faces. Each of these composite elements comprises an aluminum part, which is welded to one of the floors, and a steel part, which is welded to one of the steel faces.

In order to manufacture the composite elements, it is known to attach the aluminum part and the steel part by means of fastening elements (bolt, rivet, etc.) or by means of explosion welding, which may be expensive and complex. Moreover, because of its particular mode of implementation, this explosion welding is generally carried out in advance, separately from the other assembly steps of the structure. To this must be added the need to weld the composite element to the floors, with an aluminum-to-aluminum weld, and to the faces, with a steel-to-steel weld. As a result, a total of three different welding technologies is required to assemble the aluminum floors with the steel faces.

SUMMARY OF THE INVENTION

Accordingly, the invention aims to remedy the aforementioned disadvantages of the prior art and proposes a new body structure whose manufacture is easier and cheaper, while this new body structure is no less solid and durable than known structures.

The object of the invention is a body structure for a railway vehicle, the body structure of which comprises:

- a frame, which comprises at least one support element made at least predominantly of steel alloy, and
- at least one equipment element made predominantly at least of aluminum alloy, which comprises at least one first plate having at least one longitudinal edge, and a first face delimited by the longitudinal edge.

According to the invention, the body structure further comprises at least one longitudinal batten made of a steel alloy, which is integral with the support element, wherein the longitudinal batten is fixed flat on the first face by means of a friction melt bonding.

According to the invention, the equipment element is fixed to the support element by means of a minimum number of intermediate pieces and welds. Friction melt bonding, which is a recent and efficient technique described for example in EP A 2 844 415, may be advantageously directly implemented during the manufacture of the body structure of the invention. In fact, this friction melt bonding may be carried out by applying a rotating friction melt bonding tool to a free face of the longitudinal batten, wherein the free face is opposite to a face supported against the first face. The friction melt bonding is thus carried out by conduction through the longitudinal metal batten to fix the latter to the equipment element situated underneath. The body structure so obtained is particularly strong, durable and inexpensive.

According to other advantageous features of the invention, taken singly or in combination:

- A longitudinal flat spot is provided in the first face, on only part of this first face extending from the longitudinal edge, wherein the longitudinal batten is fixed on the equipment element flat against the longitudinal flat spot.
- Two plates are provided, wherein the first plate comprises a second face opposite the first face and a second plate parallel to the first plate, and wherein the equipment element comprises a longitudinal web which projects from a lateral part of the second face, wherein the lateral part extends from the longitudinal edge and facing the longitudinal batten, the web connects the first plate to the second plate.
- The longitudinal batten is integral with the support element and belongs to the latter.
- The longitudinal batten has a longitudinal outer edge by means of which the longitudinal batten is welded to the support element.
- The longitudinal batten has an extra thick portion which extends from the longitudinal outer edge.
- The longitudinal batten has a chamfered longitudinal inner edge, wherein the body structure comprises a sealing gasket applied against the longitudinal inner edge.
- The support element forms a truss while the equipment element forms a floor.

The object of the invention is also to provide a method for manufacturing a body structure according to the above description, wherein this manufacturing method comprises the step of fixing the longitudinal batten on the first face by means of friction melt bonding through the longitudinal batten by applying a rotating friction melt bonding tool to a free face of the longitudinal batten, wherein the free face lies opposite a support face of the longitudinal batten against the first face.

Finally, according to another advantageous characteristic of the invention, the friction melt bonding tool is applied to the free face facing the first face, while projecting beyond the longitudinal edge.

BRIEF DESCRIPTION OF THE DRAWINGS

The invention will be better understood by reading the description which follows, given solely in the form of a non-limitative and non-exhaustive example and made with reference to the drawings, wherein.

DESCRIPTION OF THE PREFERRED EMBODIMENTS

Figure 1:
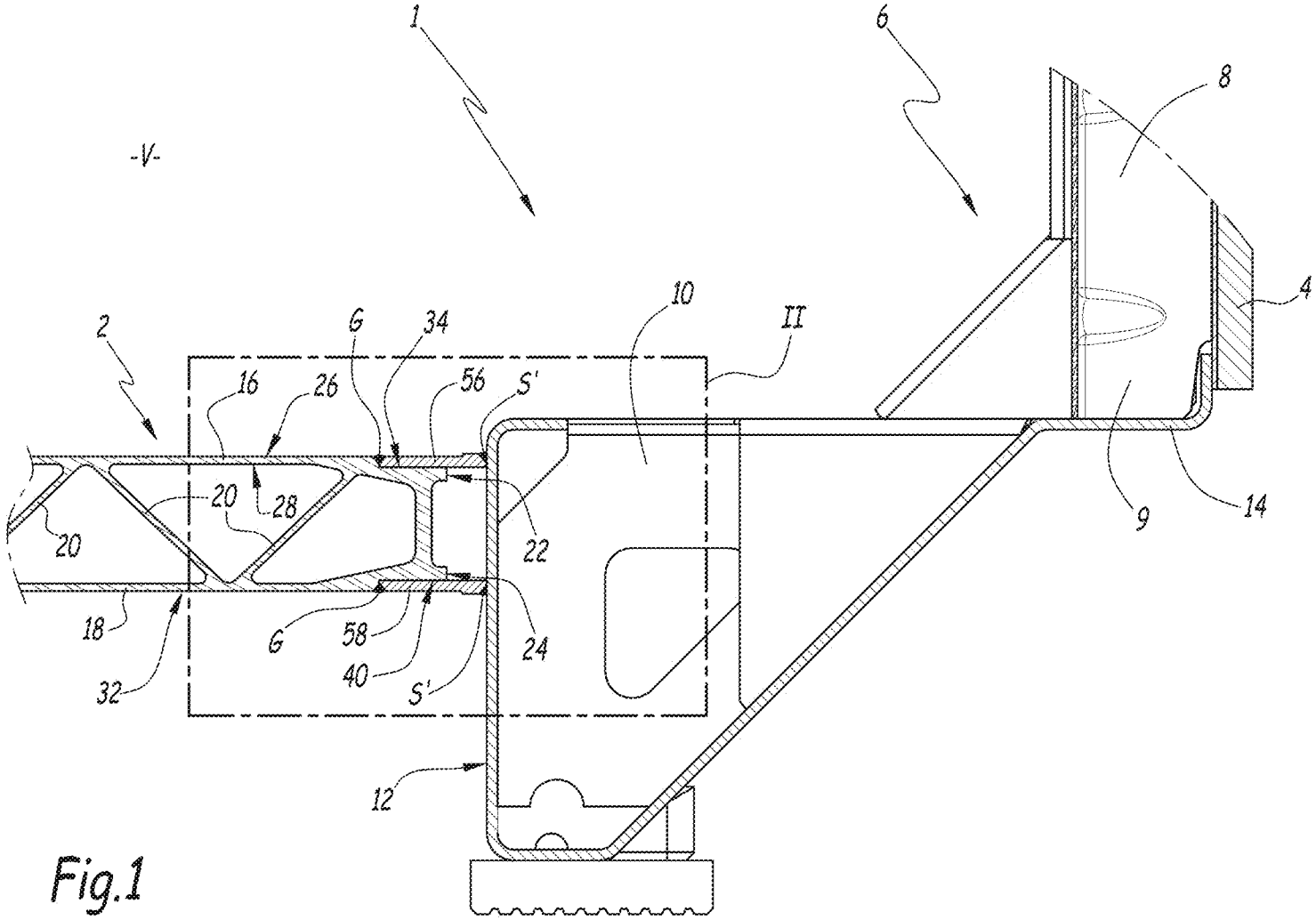
FIG. 1 shows a partial cross-section of a body structure according to a first embodiment of the invention.
Figure 2:
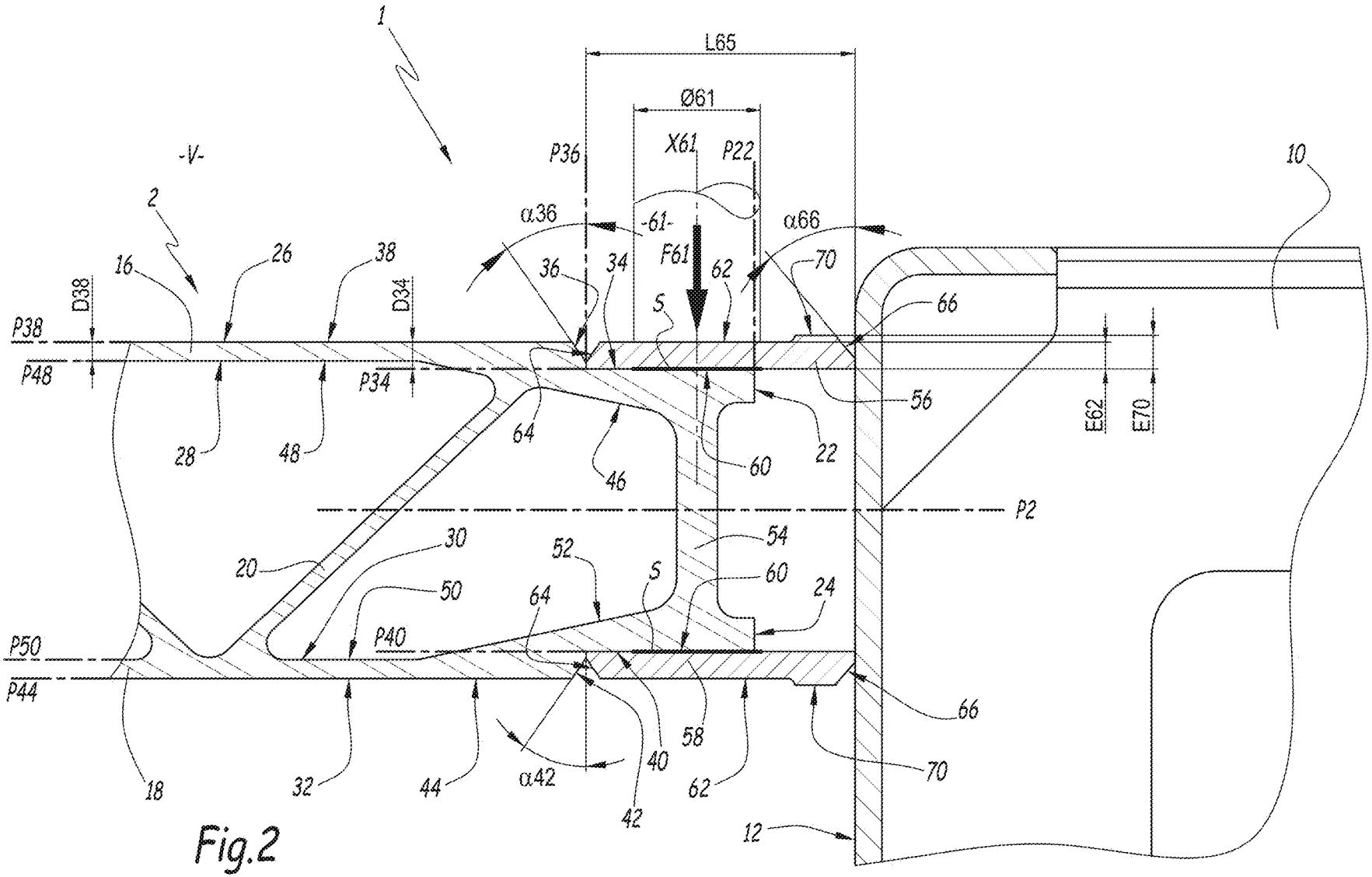
FIG. 2 shows a view on a larger scale of the detail II in FIG. 1.
Figure 3:
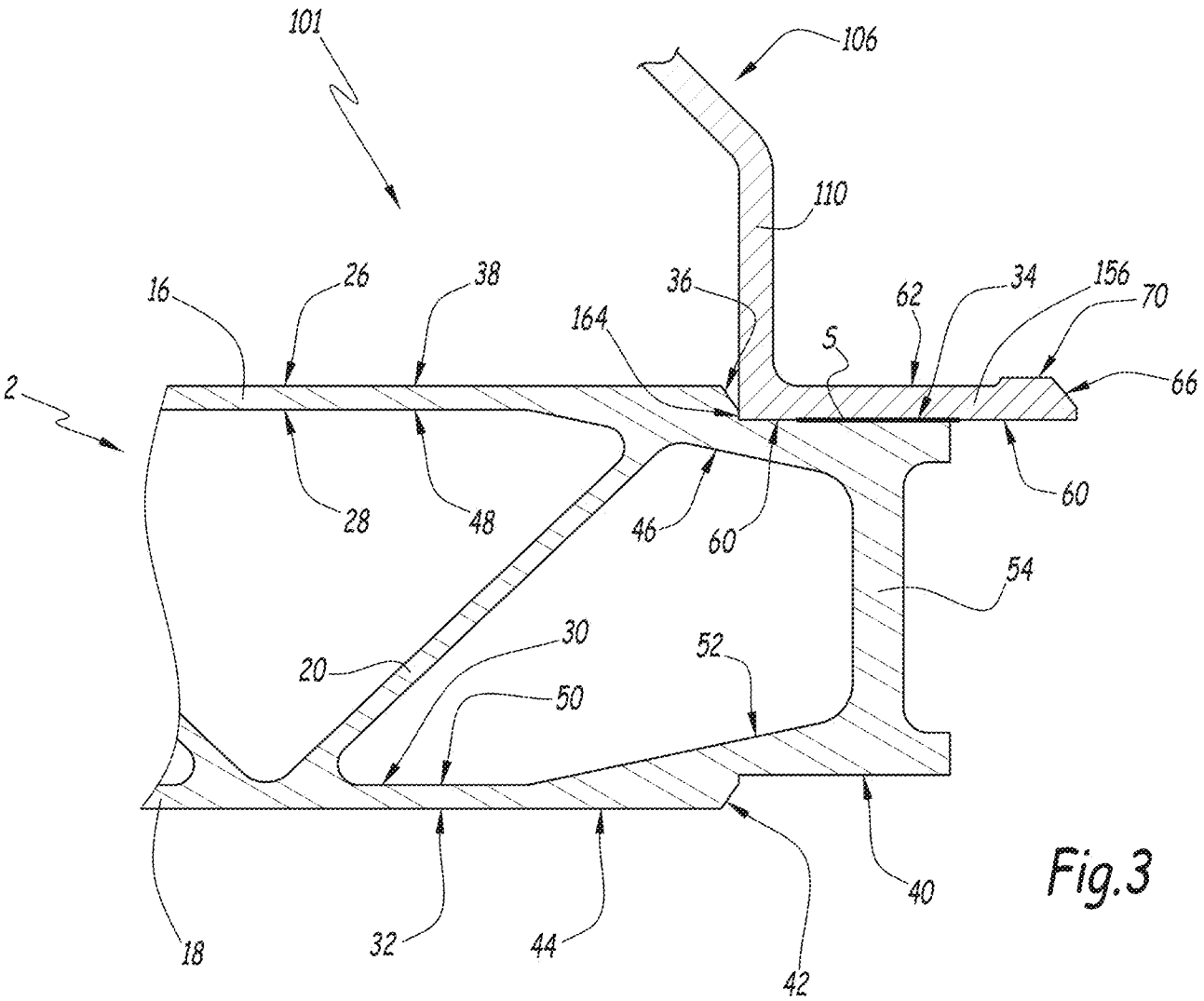
FIG. 3 shows a partial cross-section of a body structure according to a second embodiment of the invention.

In the following, the sectional plane of FIGS. 1 to 3 is referred to as a "transverse plane", so that the terms "longitudinal" and "length" designate an orthogonal, or at least intersecting, direction with respect to this transverse plane. Moreover, the terms "upper" and "top" refer to an upwardly-directed transverse direction in FIGS. 1 to 3, while the terms "lower" and "bottom" designate an opposite transverse direction. Finally, the terms "horizontal" and "vertical" respectively designate horizontal and vertical directions under normal conditions of use of the vehicle, when the latter is resting on rails: in this case, the horizontal direction is represented horizontally in the figures, while the vertical direction is shown vertically.

The structure 1 of FIGS. 1 and 2 belongs to a body of a rail vehicle, of the wagon, carriage or locomotive type, intended, for example, to form a part of the composition of a train.

The term "body" refers to the upper part of the vehicle, resting on bogies of the vehicle. The body is intended to contain persons or goods carried by the vehicle or a traction unit in the case of a locomotive. Conventionally, the body comprises at least one horizontal floor 2 and lateral walls 4, only one of which is partially visible in FIG. 1, and which rise from the floor 2 in order to delimit an interior volume V of the body. Alternatively, several floors may be provided to form levels within the body. The body preferably comprises a roof or cover (not shown) enclosing the volume V from above, and featuring inner and outer cladding elements (also not shown). The floor 2, the lateral walls 4 and the roof thus constitute equipment elements of the structure 1.

The structure 1 also comprises a chassis 6, formed predominantly by an assembly of support elements of the beam and truss type. Preferably, most of the support elements are made at least predominantly, or even totally, of steel or of a steel alloy in order to provide the chassis 6 with a predetermined mechanical strength to suit the conditions of use of the vehicle. For the most part, this means that more than 50 wt.-% of each support element is made of steel or a steel alloy. Preferably, at least the majority of the support members form metal profiles. The support members are assembled together by welding, riveting, bolting, or any other suitable technique. The chassis 6, therefore, constitutes a rigid framework, the purpose of which is, in particular, to support the equipment elements, including the floor 2 and the lateral walls 4.

Advantageously, two longitudinal rows of vertical uprights 8 form support elements for the lateral walls 4 of the body.

The frame 6 also includes at least two trusses 10, only one of which is visible in FIGS. 1 and 2, and wherein each forms a longitudinal beam of the frame 6. Each of the trusses 10 connects the vertical uprights 8 of one of the longitudinal rows to one another by being welded to these vertical uprights 8. Each truss 10 is made of steel, or of a steel alloy, at least predominantly, and preferably totally. Each truss 10 is preferably formed by a profile, i.e. a part obtained by extrusion of material, or formed by an assembly of profiled elements fixed to each other. The trusses 10 are arranged at the same height between the two rows of vertical uprights 8 and form support elements for the floor 2 of the structure 1.

In particular, each truss 10 has a fixing surface 12 that is planar and oriented in a longitudinal plane parallel to the walls 4. Each fixing surface 12 is turned towards the inside of the body, so that the two fixing surfaces 12 face one another.

Each truss 10 also preferably comprises a part 14 shaped to receive a lower end 9 of the vertical uprights 8, opposite the fixing surface 12.

The floor 2 comprises a profile at least predominantly, or even totally, made of aluminum or an aluminum alloy, so that it is particularly easy to manufacture and comprises a small number of parts. By "predominantly" is meant that more than 90 wt.-% of the floor 2 is made of aluminum or of an aluminum alloy.

The floor 2 comprises a first upper horizontal plate 16 and a second lower plate 18 disposed at a distance from and parallel to the plate 16. The plate 16 has an upper face 26 and a lower face 28 opposite each other, while the plate 18 has an upper face 30 and a lower face 32 opposite each other. The plate 16, and, in particular, its faces 26 and 28, end laterally in two longitudinal edges 22, only one of which is visible in FIGS. 1 and 2, with respect to the fixing surface 12, wherein each forms a vertical surface extending in a longitudinal plane and between which the body of the plate 16 extends. Similarly, the plate 18, and in particular its faces 30 and 32, end laterally in two longitudinal edges 24 whose surface extends in the same plane as that of the corresponding longitudinal edges 22 of the plate 16.

Two longitudinal flat spots 34 are formed in the upper face 26, wherein each extends from one of the edges 22 to a longitudinal chamfer 36 of the upper face 26 of the first upper plate 16. In the example of FIG. 2, the chamfer 36 defines an angle $\alpha$36 equal to approximately 35°, wherein the angle $\alpha$36 is measured with respect to a plane parallel to the surface of the edge 22. The upper face 26 also comprises a substantially flat central part 38 delimited by the two chamfers 36. Likewise, two longitudinal flat spots 40 are formed in the bottom face 32 of the second bottom plate 18, wherein each extends from one of the edges 24 to a longitudinal chamfer 42 of the lower face 32. As illustrated in FIG. 2, the chamfer 42 defines an angle $\alpha$42 equal to the value of the angle $\alpha$36, wherein the angle $\alpha$42 is measured with respect to a vertical plane parallel to the surface of the edge 24. The lower face 32 also comprises a substantially flat central part 44 delimited by the two chamfers 42.

The lower face 28 of the first upper plate 16 comprises a central portion 48 and two lateral portions 46 extending on either side of the central part 48 to the longitudinal edges 22. Each lateral portion 46 extends in a direction opposite to the edge 22, i.e. on the opposite side of one of the flat spots 34, and extends, in a direction opposite to the edge 22, beyond the corresponding flat spot 34. The central part 48 extends in an intermediate plane P48 disposed between an upper plane P38 defined by the central part 38 of the upper face 26, and a flat spot plane P34 defined by the longitudinal flat spot 34. In other words, the depth of the flat spot 34 is greater than the thickness of a central zone delimited by the central portions 38 and 48 of the faces 26 and 28 of the plate 16, which makes it possible to optimize the mass of the floor 2, while giving it a high mechanical resistance. In the example of FIGS. 1 and 2, the vertical distance D38 between the planes P38 and P48 is 2.8 mm, while the vertical distance D34 between the planes P38 and P46 is 4 mm.

The upper face 30 comprises a central portion 50 and two lateral portions 52 extending on either side of the central portion 50 to the longitudinal edges 24. Each lateral part 52 lies opposite, i.e. on the opposite side of one of the flat spots 40, and extends in a direction opposite to the edge 24 beyond the corresponding flat spot 40. The central portion 50 extends in an intermediate plane P50 arranged between a lower plane P44 defined by the central portion 44 of the lower face 32, and a flat spot plane P40 defined by the longitudinal flat spot 40. In other words, the depth of the flat spot 40 is greater than the thickness of a central zone delimited by the central portions 44 and 50 of the faces 30 and 32 of the plate 18, which makes it possible to optimize the mass of the floor 2 while giving it a high mechanical resistance.

The floor 2 comprises two longitudinal webs 54 disposed close to the longitudinal edges 22 and 24, and only one of which is visible in FIGS. 1 and 2. Each longitudinal web 54 interconnects the plates 16 and 18. In particular, each longitudinal web 54 extends in a plane perpendicular to the flat spot planes P34 and P40 and projects from the lateral portion 46 of the lower face 28 to the lateral portion 52 facing the upper face 30. Each longitudinal web 54 thus extends into an intermediate position between a vertical plane P36 defined by the base of the chamfers 36 and a vertical plane P22 defined by the edges 22 and 24. The webs 54 are integral with the plates 16 and 18.

In a manner known per se, the lower face 28 is connected to the upper face 30 by oblique cladding 20 to stiffen the floor 2 and which is integral with the plates 16 and 18. The oblique cladding 20 is disposed between the two longitudinal webs 54. Alternatively, the floor 2 may be devoid of oblique cladding, and instead comprise other stiffening means, or is devoid of stiffening means.

It will be understood that an extreme portion of the floor 2, including the flat spots 34 and 40, the web 54, the edges 22 and 24, is symmetrical with respect to a plane of symmetry P2 defined equidistantly from the plates 16 and 18.

The floor 2 is assembled with the trusses 10 by means of four longitudinal battens of steel alloy, wherein only two battens 56 and 58 are visible in FIGS. 1 and 2. The two longitudinal battens 56 are fixed flat on the flat spots 34, while the two longitudinal battens 58 are fixed flat on the flat spots 40, respectively. Each batten 56 and 58 comprises a support face 60 which bears against the flat spots 34 or 40, and an opposite free face 62. Each batten 56 and 58 is delimited transversely by a longitudinal internal edge 64 and a longitudinal outer edge 66 ending the faces 60 and 62. For each batten 56 or 58, the support face 60 covers the flat spot 34 or 40, so that the inner edge 64 is in contact with the chamfer 36 or 42 respectively. Each batten 56 or 58 extends beyond the edge 22 or 24 concerned, so that a portion of each batten 56 and 58 projects beyond the floor 2 beyond the plane P22.

Each batten 56 and 58 is secured to the floor 2 via its support face 60, which is welded to the flat spot 34 or 40 and against which it is supported by means of a friction melt bonding S. In order to effect this friction melt bonding S, a rotating friction melt bonding tool 61 is rotated against the free face 62 of the longitudinal batten 56 or 58 concerned, in order to heat this batten 56 or 58 through friction, so that the frictional heat is transmitted to the floor 2 through the batten 56 or 58 concerned, at the longitudinal flat spot 34 or 40 concerned, which results in the welding of the steel alloy of the batten 56 or 58 with the aluminum alloy of the floor 2. In practice, the tool 61 is applied against the batten 56 or 58 with a predetermined force F61, wherein the force F61 is directed along an axis X61 of the tool 61, and wherein this axis X61 is perpendicular to the flat spot 34 or 40 concerned, when the tool 61 is in contact with the batten 56 or 58. The tool 61 is rotated about the axis X61. The tool 61 is moved along the batten 56 or 58, while being rotated about the axis X61 and being applied with the force F61, in order to create a continuous, or even discontinuous, weld S. The presence of the web 54 enables the floor 2 to resist the forces involved during this friction melt bonding S. In this case, the web 54 is disposed opposite each batten 56 and 58, i.e. under, on the other side of the plate 16 or 18 concerned, in order to improve the bending resistance of this plate 16 or 18. Thus, to effect the weld S, the tool 61 is positioned vertically above the web 54, i.e. in the axis of the latter. In other words, the axis X61 is aligned with a median plane of the web 54, as illustrated in FIG. 2.

The tool 61 has one end, applied to the batten 56 or 58, the shape of which is cylindrical with a circular base about the axis X61. It is provided that this end has a diameter $\phi$61 that is sufficiently high for the contact surface between the tool 61 and the batten 56 or 58 to project beyond the edge 22 or 24 of the flat spot 34 or 40, in order to ensure that the friction melt bonding S extends at least as far as the edge 22 or 24 concerned, or even beyond the edge 22 or 24, in order to ensure the sealing of the weld S at the support face 60. In other words the tool 61 is crossed by the plane P22 during the welding S. In the example illustrated in FIG. 2:

- the width L65 of the battens 56 and 58, measured between the edges 64 and 66 parallel to the support face 60, is 40 mm,
- the diameter $\phi$61 is, for example, between 10 and 25 mm,
- the tool protrudes 1 to 2 mm from the edge 22.

It is provided that the battens 56 and 58 are sufficiently thin to facilitate heat transmission to the floor 2 during the friction melt bonding. In the example of FIG. 2, the thickness E62 of the batten, measured between the free face 62 and the support face 60, is 4 mm. In practice, the thickness E62 is equal to the distance D34, so that the face 62 is coplanar with the central portion 38 of the upper face 26.

Each longitudinal outer edge 66 is chamfered to accommodate a steel-to-steel weld S' to secure the respective batten 56 or 58 to the fixing surface 12. The chamfer of the edge 66 is provided on the side of the free face 62 and has an angle $\alpha$66 of 40° with respect to a plane that is orthogonal to the support face 60. Each longitudinal batten 56 and 58 has a thickened portion 70 projecting from the free face 62 and extending from the chamfered longitudinal outer edge 66. The presence of this thickened portion 70 ensures the strength and durability of the steel-to-steel welding. In the example of FIG. 2, the battens 56 and 58 have a thickness E70 of 5 mm, measured between the thickened portion 70 of the free face 62 and the support face 60.

The chamfer of the longitudinal outer edge 66 for the weld S' is located at a sufficient distance away from the longitudinal edge 22 and therefore from the weld S, in order to avoid harmful heating which would adversely affect the mechanical strength of this weld S, and, in particular, to avoid any risk of delamination of the latter. This distance ensures the strength and durability of the weld S. For the sake of clarity, the steel-to-steel weld beads S' are only shown in FIG. 1.

Alternatively, the battens 56, 58 need not be fixed to the surface 12 by welding, but rather secured by any other suitable means, for example riveting. In this case, the shape of the truss 10 is modified to receive the rivets.

Each longitudinal inner edge 64 is also chamfered in order to form a V-shaped groove with the adjacent chamfer 36 or 42. The inclination of the chamfer 64 is equal to that of the adjacent chamfers 36 or 42. The V-shaped groove thus formed is filled with a sealing gasket G that is only represented in FIG. 1 (for the clarity of the drawing) in the form of a filler to ensure the sealing of the friction melt bonding S.

Alternatively, the floor 2 is not obtained by extrusion but by another manufacturing method, as are also the truss 10 and the support element 110.

Alternatively, only one of the battens 56 or 58 is fixed to the floor 2 by means of friction melt bonding S, wherein the other battens are fixed by another suitable method, such as riveting.

A body structure 101 according to the second embodiment of the invention shown in FIG. 3 is described below.

This body structure 101 has similar characteristics with the body structure 1 of FIGS. 1 and 2. The description which follows is therefore centered on the differences between this second embodiment of FIG. 3 and the first embodiment of FIGS. 1 and 2. In particular, the reference numerals of FIG. 3, which are common to those of FIGS. 1 and 2, refer to the same features and objects which have been described above for the first embodiment where these characteristics and objects are found in the second embodiment.

The body structure 101 of FIG. 3 comprises a floor 2 identical to that described above, a longitudinal batten 156 and a frame 106, which differ from the battens 56 and 58 and the frame 6 described above in that the longitudinal batten 156 is integral with a support element 110 of the frame 6 and thus belongs to this support element 110. As a result, the floor 2 is directly fixed on the support element 110 by means of a friction melt bonding S, wherein the support member 110 comprises a portion in the form of a longitudinal batten 156.

The longitudinal batten 156 has a free face 62 with a thickened portion 70, an outer edge 66 and a support face 60 similar to those of the first embodiment of FIGS. 1 and 2. The friction melt bonding S of the batten 156 on the floor 2 may therefore be carried out in the same way with a similar tool as that used for the batten 56 on the floor 2 of the first embodiment.

The outer edge 66 is optionally welded or attached to a support member (not shown) of the steel alloy of the frame 106.

The longitudinal batten 156 is extended from a longitudinal edge 164 of the free face 62 lying opposite to the outer edge 66, by the support member 110, which protrudes upwards from the free face.

Alternatively, the floor 2 may be replaced by any aluminum alloy equipment element of the structure 1, wherein the truss 10 and the support element 110 are replaceable by any steel alloy support element of the structure body structure. For example, the aluminum alloy equipment element may be a cover belonging to structure 1, or an intermediate floor to form an intermediate level in the case of a multi-level floor structure.

Furthermore, the steel alloy support member may be formed by a steel alloy cover, a steel alloy floor, or a steel alloy deck. Alternatively, the equipment element may be secured to the support member with a single batten 56 or 58 and a single friction melt bonding S.

The various embodiments and variants described above may be combined to create new embodiments.

The invention claimed is:

1. A body structure for a railway vehicle, the body structure comprising:

a frame, which comprises at least one support element made at least predominantly of steel alloy;

at least one equipment element, made at least predominantly of aluminum alloy, and comprising at least a first plate comprising at least one longitudinal edge and a first face delimited by the longitudinal edge; and at least one longitudinal steel batten which is integral with the support element, wherein the longitudinal batten is fixed flat on the first face by means of friction melt bonding, a support face of the batten being fixed to the first face, and wherein the longitudinal batten has a longitudinal outer edge by means of which the longitudinal batten is welded on the support element, the longitudinal batten having a thickened portion extending from the longitudinal outer edge and projecting from a free face, opposite to the first face, and the outer edge having a welding chamfer.

2. The body according to claim 1, wherein a longitudinal flat spot is provided in the first face on only part of this first face extending from the longitudinal edge, wherein the longitudinal batten is fixed flat against the longitudinal flat spot.

3. The body according claim 1, wherein the first plate is one of two plates are provided, the first plate having a second face opposite the first face, and a second plate of the two plates being parallel to the first plate, wherein the equipment element comprises a longitudinal web which protrudes from a lateral portion of the second face, wherein the lateral portion extends from the longitudinal edge with respect to the longitudinal batten, and wherein the web connects the first plate to the second plate.

4. The body according to claim 1, wherein the longitudinal batten is integral with, and belongs to, the support element.

5. The body according to claim 1, wherein the longitudinal batten has a chamfered longitudinal internal edge, and wherein the body structure comprises a sealing gasket applied against the longitudinal internal edge.

6. The body according to claim 1, wherein the support element forms a truss, and wherein the equipment element forms a floor.

7. A method of manufacturing a body structure according to claim 1, the method comprising a step of fixing the longitudinal batten on the first face by means of friction melt bonding through the longitudinal batten by applying a rotating friction melt bonding tool to a free face of the longitudinal batten, wherein the free face lies opposite a support face of the longitudinal batten against the first face.

8. The method according to claim 7, wherein the friction melt bonding tool is applied to the free face, the melt bonding tool facing the first face beyond the longitudinal edge.

* * * * *